US011066227B2

(12) United States Patent
Banoun et al.

(10) Patent No.: US 11,066,227 B2
(45) Date of Patent: Jul. 20, 2021

(54) BAG FOR CARRYING ARTICLES

(71) Applicant: Benjamin Banoun, Paris (FR)

(72) Inventors: Benjamin Banoun, Paris (FR); Fabrice Mantelet, Paris (FR)

(73) Assignee: Benjamin Banoun, Paris (FR)

( * ) Notice: Subject to any disclaimer, the term of this patent is extended or adjusted under 35 U.S.C. 154(b) by 0 days.

(21) Appl. No.: 16/094,250

(22) PCT Filed: Apr. 12, 2017

(86) PCT No.: PCT/FR2017/050879
§ 371 (c)(1),
(2) Date: Oct. 17, 2018

(87) PCT Pub. No.: WO2017/182737
PCT Pub. Date: Oct. 26, 2017

(65) Prior Publication Data

US 2019/0127138 A1 May 2, 2019

(30) Foreign Application Priority Data

Apr. 18, 2016 (FR) ..... 1653399

(51) Int. Cl.
*B65D 81/36* (2006.01)
*B65D 30/18* (2006.01)
(Continued)

(52) U.S. Cl.
CPC ..... *B65D 81/36* (2013.01); *B31B 70/866* (2017.08); *B65D 31/08* (2013.01); *B65D 31/10* (2013.01);
(Continued)

(58) Field of Classification Search
CPC ..... B65D 81/36; B65D 31/08; B65D 31/10; B65D 33/00; B65D 33/105; B31B 70/866; B31B 2160/20; B31B 2150/0012
(Continued)

(56) References Cited

U.S. PATENT DOCUMENTS 1,359,856 A * 11/1920 Anderson ..... B65D 31/005 383/88
1,385,831 A * 7/1921 Hulbert ..... B65D 5/2052 383/88
(Continued)

FOREIGN PATENT DOCUMENTS

EP 1 595 811 A1 11/2005
FR 2 813 292 A1 3/2002

OTHER PUBLICATIONS

International Search Report of PCT/FR2017/050879 dated Jun. 9, 2017 [PCT/ISA/210].
International Preliminary Report on Patentability with English Translation of the Written Opinion of PCT/FR2017/050879 dated Nov. 1, 2018.

*Primary Examiner* — Peter N Helvey
(74) *Attorney, Agent, or Firm* — Sughrue Mion, PLLC

(57) ABSTRACT

An article carrier bag, in particular of the fastfood takeaway type, the bag comprising a bottom and sides (F12, F13) defining inside walls bounding an inside storage space, and being characterized in that at least one gusset element (E1) in a folded state is fitted to and fastened on at least one inside wall of the sides (F12, F13) in two adjacent fastener zones that are separated by a frangible zone (F15) provided in association with at least one side (F12, F13), so as to be capable of bringing the gusset element (E1) into an unfolded state after breaking the frangible zone (F15).

7 Claims, 6 Drawing Sheets

Figure 2A:
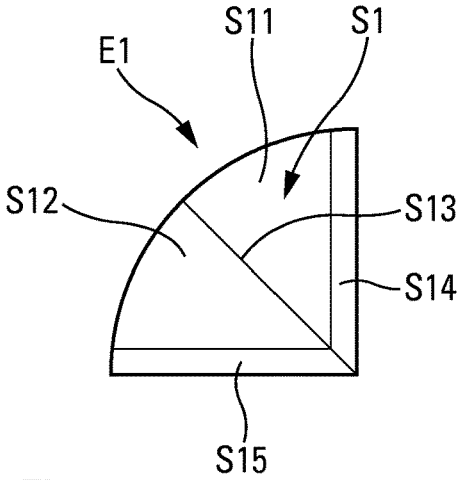

(51) Int. Cl.

| | |
|---|---|
| ***B65D 30/20*** | (2006.01) |
| ***B65D 33/10*** | (2006.01) |
| ***B31B 70/86*** | (2017.01) |
| ***B65D 33/00*** | (2006.01) |
| *B31B 160/20* | (2017.01) |
| *B31B 150/00* | (2017.01) |

(52) U.S. Cl.
CPC ..... *B65D 33/00* (2013.01); *B65D 33/105* (2013.01); *B31B 2150/0012* (2017.08); *B31B 2160/20* (2017.08)

(58) Field of Classification Search
USPC ..... 383/4
See application file for complete search history.

(56) References Cited

U.S. PATENT DOCUMENTS

| | | | | |
|---|---|---|---|---|
| 2,690,199 | A * | 9/1954 | Bennorth | B65D 33/00 383/111 |
| 2,831,624 | A * | 4/1958 | Lever | A45C 11/20 383/4 |
| 5,328,265 | A * | 7/1994 | Clooney | A45C 9/00 383/122 |
| 7,188,713 | B1 * | 3/2007 | Espar | A45C 7/0095 190/107 |
| 2006/0169691 | A1 | 8/2006 | Rothschild et al. | |
| 2010/0065465 | A1 | 3/2010 | Delgado | |
| 2013/0034314 | A1 | 2/2013 | Peacock | |
| 2016/0083143 | A1 | 3/2016 | Padan | |

* cited by examiner

BAG FOR CARRYING ARTICLES

CROSS REFERENCE TO RELATED APPLICATIONS

This application is a National Stage of International Application No. PCT/FR2017/050879, filed Apr. 12, 2017, claiming priority based on French Patent Application No. 1653399, filed Apr. 18, 2016.

The present invention relates to an article carrier bag, in particular of the fastfood takeaway type, comprising a bottom and sides defining internal walls bounding an internal storage space. In general, this type of bag is made of paper, such as kraft paper, or else of plastics material. The preferred field of application of the present invention is thus that of packaging and carrying various articles, and more particularly beverages and cooked dishes.

In conventional manner, this type of article carrier bag is made from a roll of sheet material that is fed through a series of profilers to end up constituting an article carrier bag. More particularly, a first series of profilers serve to roll up and close the sheet so as to constitute a continuous cylinder. Thereafter, a second series of profilers makes several folds, like for an envelope, so as to constitute the bottom of the bag. Optionally, it is also possible to incorporate handles, in particular by adhesive, upstream from the first series of profilers. In the end, a bag is obtained having sides that form a closed loop or cylinder, while the bottom is obtained by successive folds and adhesive, generally like an envelope. That is a design that is entirely usual or conventional for a fastfood takeaway type bag.

In the context of a fastfood business, articles ordered by a customer are placed on the bottom of the bag while it is standing upright. The customer thus leaves with the full bag, which is taken to the location where the customer has decided to consume the purchase. A user can extract articles from the bag in order to place them on a table. Certain customers are in the habit of tearing the bag along the edges connecting its sides together. Thus, once the bag is fully torn apart, it is in the form of a cross having four arms, with the bottom constituting the central portion. The purchased articles can then be laid out on the torn-apart and unfolded bag. Customers or users thus make use of the bag as a kind of tablecloth on which they consume the purchased articles. Nevertheless, the cross shape of the tablecloth provides coverage that is fragmented, so there is a risk of dirtying the surface underlying the bag/tablecloth between its sides that are arranged in a cross. In other words, the bag serves to provide a tablecloth but its effectiveness is very limited.

In the prior art, and by way of example, Document FR 2 813 292 is known, which describes a bag made up of a sheet in a single piece forming a bottom and four sides, together with connecting sectors interconnecting pairs of adjacent sides. When the container is formed, the connecting sectors are folded like a fan or a gusset under the action of a drawstring that also serves as a handle. When the container is in its folded-out flat state, it provides a coverage area similar to a square tablecloth with round corners. Consequently, that particular bag comprises a bottom in a single piece (not obtained by folding) together with side walls that are connected to one another, not continuously, but via connecting segments. With such a design, the initial state of the container before folding is identical to its final state after unfolding. In summary, the starting material is a plane sheet in a single piece that is used to constitute a container which can be unfolded into its initial shape of a sheet in a single piece. With such an architecture, it is not possible to fabricate the bag on a fabrication line of the kind described above, that enables the side walls to be made in the form of a continuous cylinder together with a bottom formed by successive folding.

An object of the present invention is to remedy the above-mentioned drawbacks of the prior art by defining another type of bag that can be unfolded into the form of a tablecloth but that can be fabricated automatically, in particular on a fabrication line as described above. Another object of the present invention is to make a bag of starting structure prior to folding that is different from its final structure after unfolding. Another object of the present invention is to enable it to be performed without completely changing the usual design of conventional bags.

In order to achieve these various objects, the present invention provides an article carrier bag, in particular of the fastfood takeaway type, the bag comprising a bottom and sides defining inside walls bounding an inside storage space, and being characterized in that at least one gusset element in a folded state is fitted to and fastened on at least one inside wall of the sides in two adjacent fastener zones that are separated by a frangible zone provided in association with at least one side, so as to be capable of bringing the gusset element into an unfolded state after breaking the frangible zone. Thus, the bottom and the sides are made of a single piece of sheet having one or more gusset elements of the invention fastened thereto prior to being folded in order to form the article carrier bag. After breaking the frangible zone(s), the container can be opened by unfolding the gusset element(s). Consequently, the initial state of the bag before folding does not correspond at all with its final state after unfolding. While the bag is in the shape of a bag, the gusset element(s) is/are completely inoperative, being prevented from unfolding by the still-intact frangible zones. As a result, before its frangible zone(s) is/are broken, the container presents a configuration that is entirely conventional, with its sides connected to one another in continuous manner.

In this respect, it is possible to make the bag with its sides connected together so as to form a continuous cylinder and its bottom being made up of a plurality of superposed folded flaps, as explained above with reference to the conventional fabrication machine. Nevertheless, it is possible to implement the present invention with a different bag architecture.

In a first embodiment, two adjacent sides form a connecting edge, the frangible zone being provided at the connecting edge, the two adjacent fastener zones being provided respectively on the two adjacent sides on either side of the frangible zone. Advantageously, the gusset element comprises a gusset, advantageously in the form of one fourth of a circle in the folded state and one eighth of a circle in the folded state, between the two fastener tabs that extend in parallel and in adjacent manner in the folded state and at right angles in the unfolded state. In other words, the bag may be provided with one, two, three, or preferably four gusset elements, each in the form of one fourth of a circle when in the unfolded state and one eighth of a circle when in the folded state. In this folded state, the fastener tabs are adjacent and may be fastened, e.g. by adhesive, on either side of the connecting edges that form the frangible zones. For example, provision may be made for a connecting edge to be weakened in its thickness, to be perforated by dots, or indeed to be split open over a certain length.

In a second embodiment of the invention, the frangible zone is formed in a side, the two adjacent fastener zones being provided on the side, respectively on either side of the frangible zone. Advantageously, the gusset element comprises two gussets, each between two fastener flaps, advantageously in the form of isosceles right triangles, that extend adjacent to each other in the folded state and at right angles in the unfolded state. Preferably, the gusset element is made from a sheet presenting a width together with a length that corresponds to four times its width so as to define an alignment of four squares, each square being folded along one of its diagonals so as to define eight isosceles right triangles, two pairs of adjacent isosceles right triangles being connected together via their points respectively forming the two gussets, while the other four isosceles right triangles form the four fastener zones, the frangible zone having two frangible lines connected together at right angles at a junction point, advantageously having a frangible segment connected thereto, in particular in the form of a tear-off pull strip that extends over the height of the side. In this second version, the bag is provided with one gusset element, or preferably with two gusset elements, arranged in the bottom portions of two opposite sides, in the proximity of the bottom. The frangible segment and the two frangible lines together present a shape that is similar to an upside-down letter Y.

Regardless of whether it is in its first embodiment or its second embodiment, the bag has one to four gusset elements fitted thereto and fastened astride one to four frangible zones made in or association with the sides.

The present invention also provides a fabrication method for fabricating an article carrier bag comprising a bottom and sides defining an inside storage space, the method comprising the following steps:

a—providing a plane sheet;

b—making at least one frangible zone in the plane sheet;

c—fitting at least one gusset element in a folded state on the plane sheet;

d—fastening the gusset element in the folded state on the plane sheet via two adjacent fastener zones that are separated by the frangible zone;

e—optionally fastening handles on the plane sheet;

f—rolling up and closing the plane sheet so as to form a continuous cylinder forming the sides; and g—folding one end of the continuous cylinder so as to form the bottom.

This fabrication method can easily be performed on a conventional fabrication machine. This fabrication method makes it possible to make a bag in accordance with the above-described first embodiment or second embodiment.

The spirit of the invention lies in the fact of fitting gusset elements to the inside of the sides of the bag and fastening them thereto while providing frangible or breakable zones in association with the sides in order to allow the bag to be folded, the frangible zones to be broken, and the gusset elements to be deployed, so as to obtain a final configuration that is similar to a conventional tablecloth.

The invention is described more fully with reference to the accompanying drawings giving two embodiments of the invention as non-limiting examples.

Figure 2B:
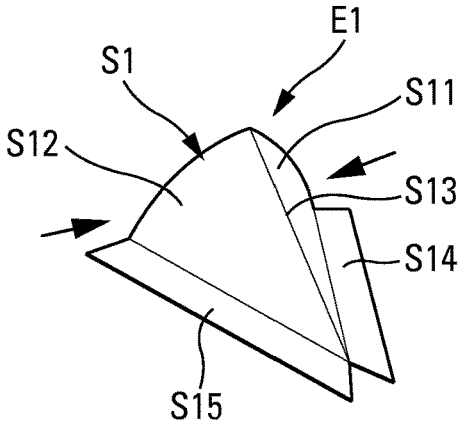
Figure 2C:
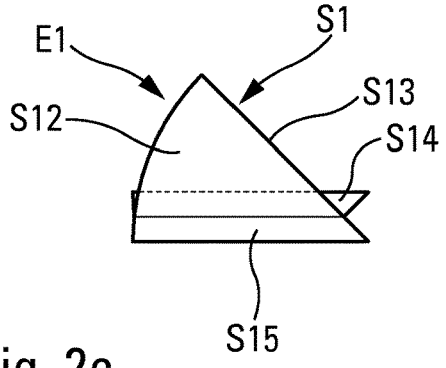
Figure 1A:
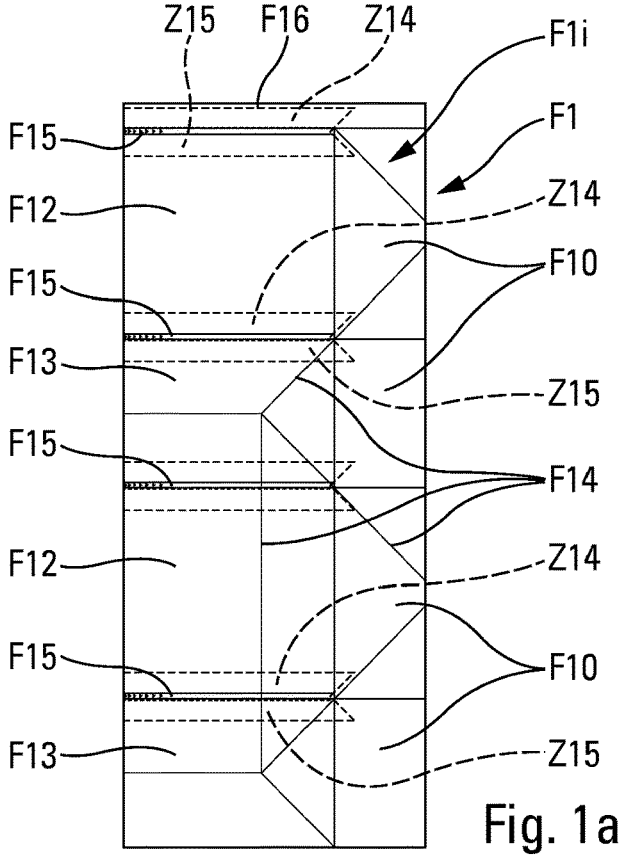
Figure 1B:
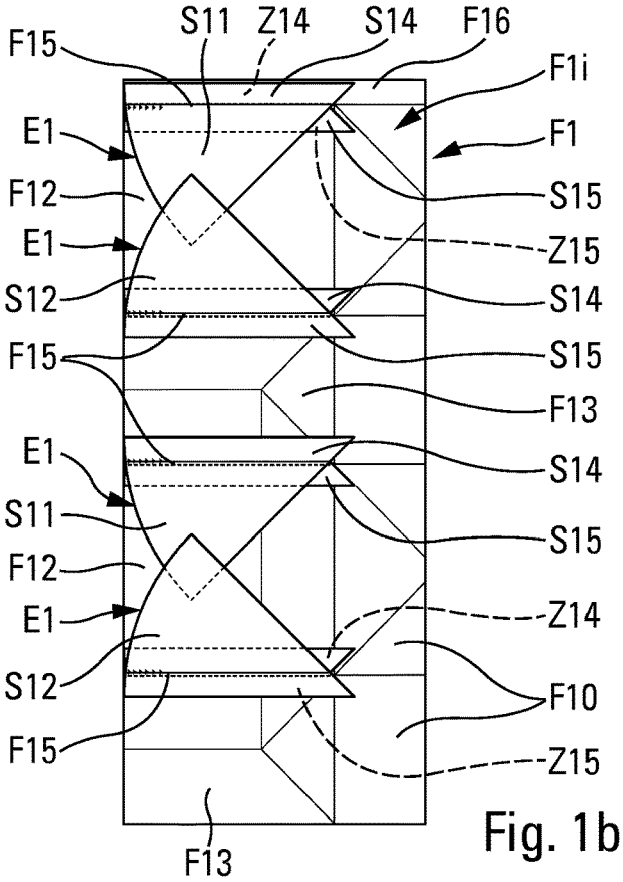
Figure 4B:
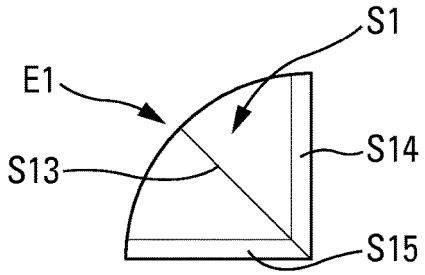
Figure 4D:
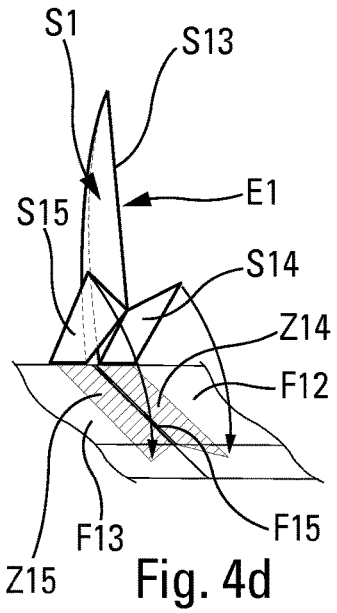
Figure 4A:
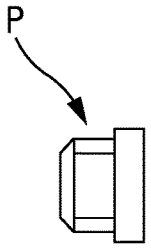
Figure 4C:
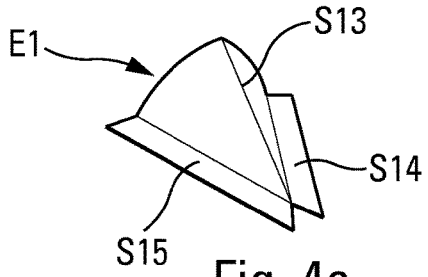
Figure 3A:
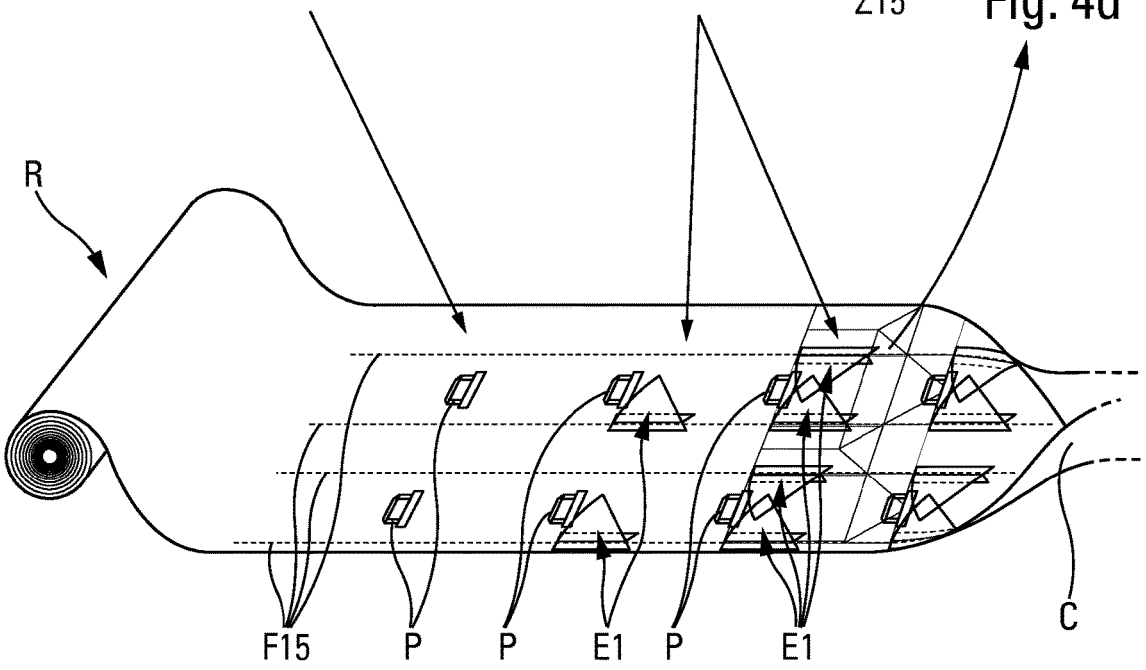
Figure 3B:
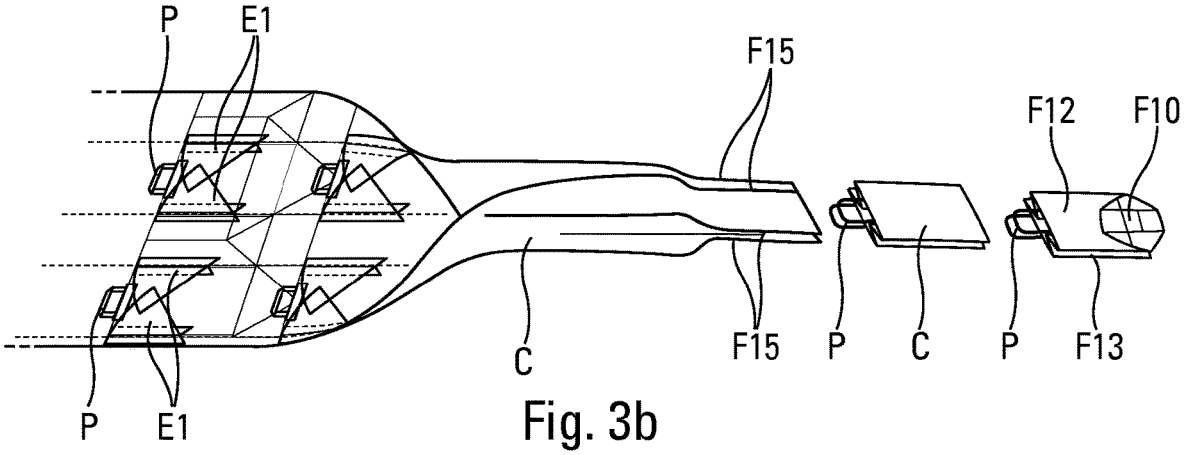
Figure 5A:
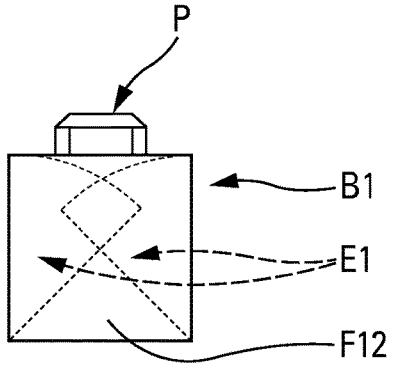
Figure 5B:
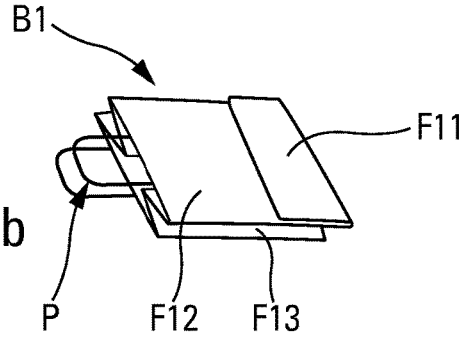
Figure 5C:
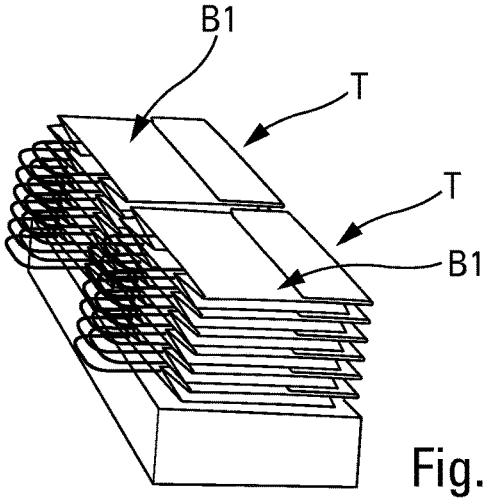
Figure 6A:
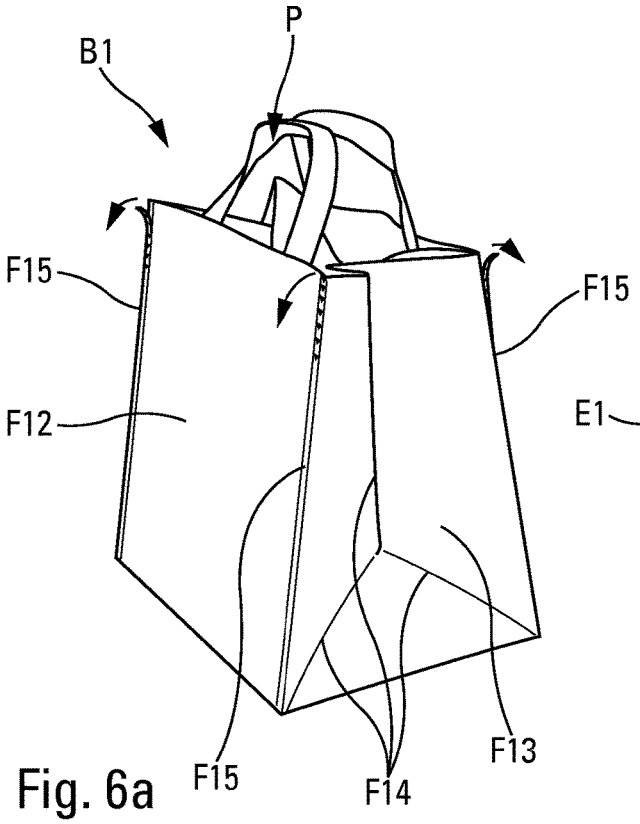
Figure 6B:
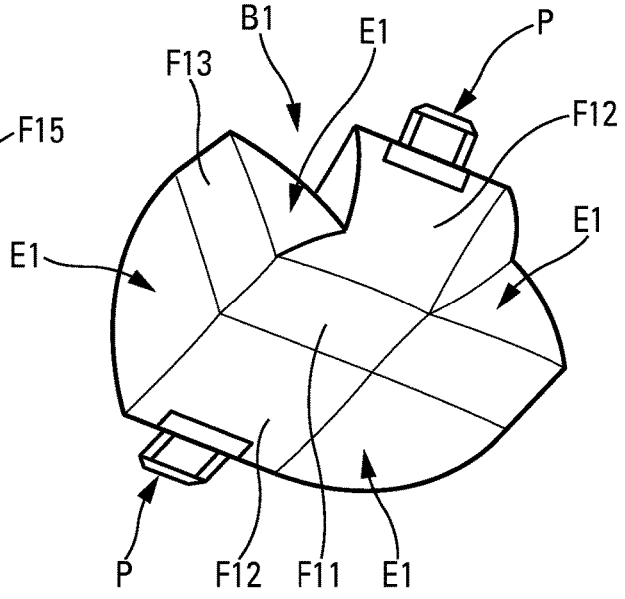
Figure 6C:
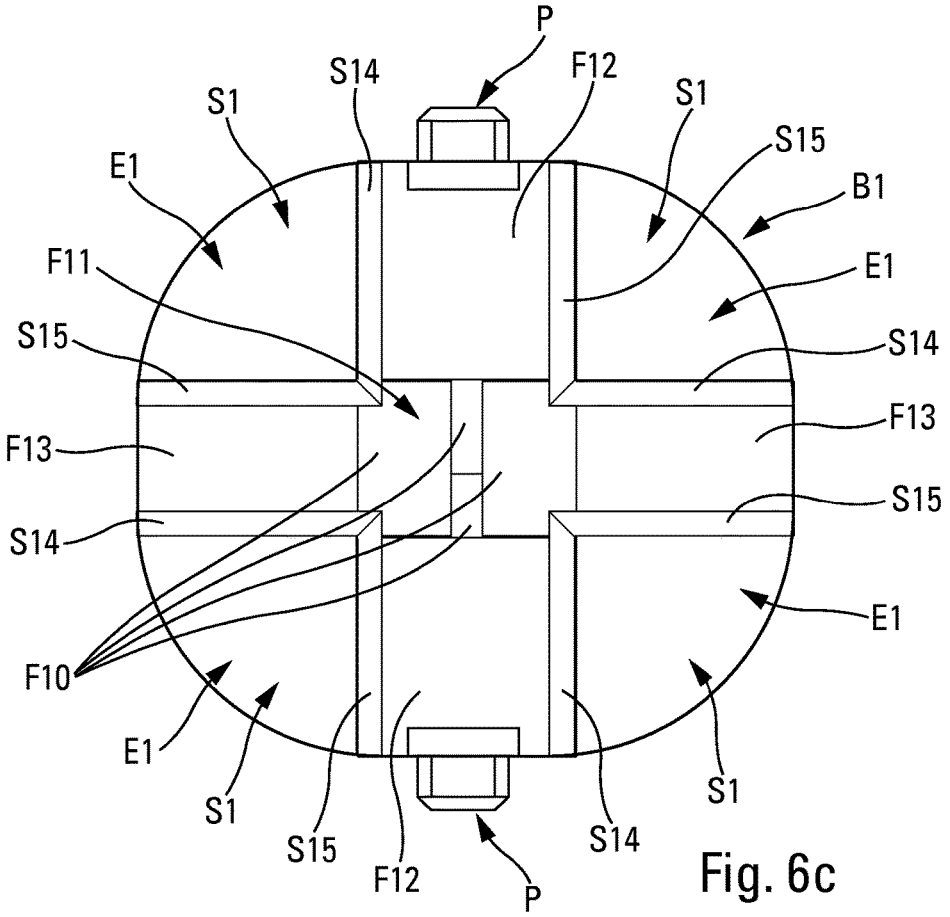
Figure 8A:
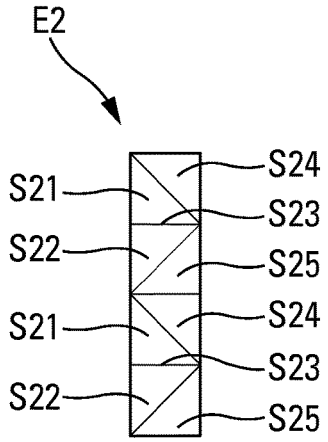
Figure 8B:
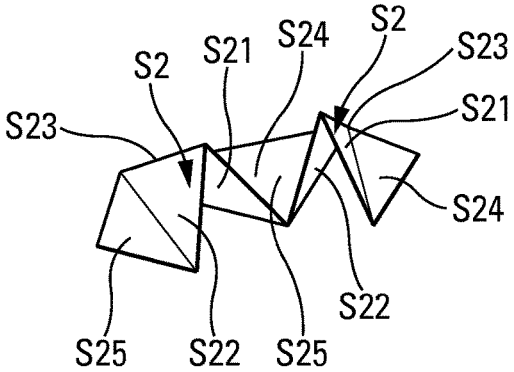
Figure 8C:
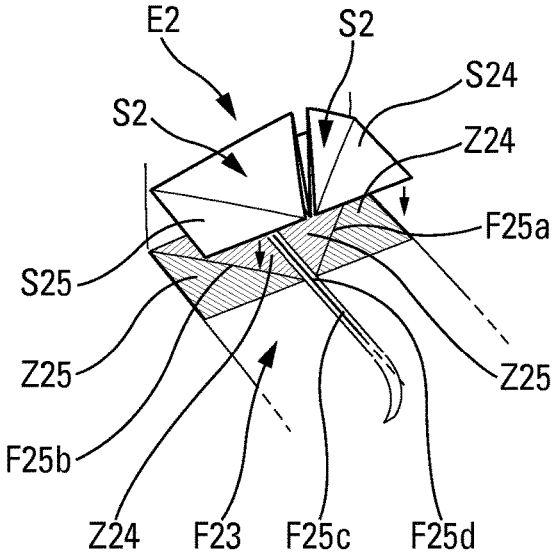
Figure 7A:
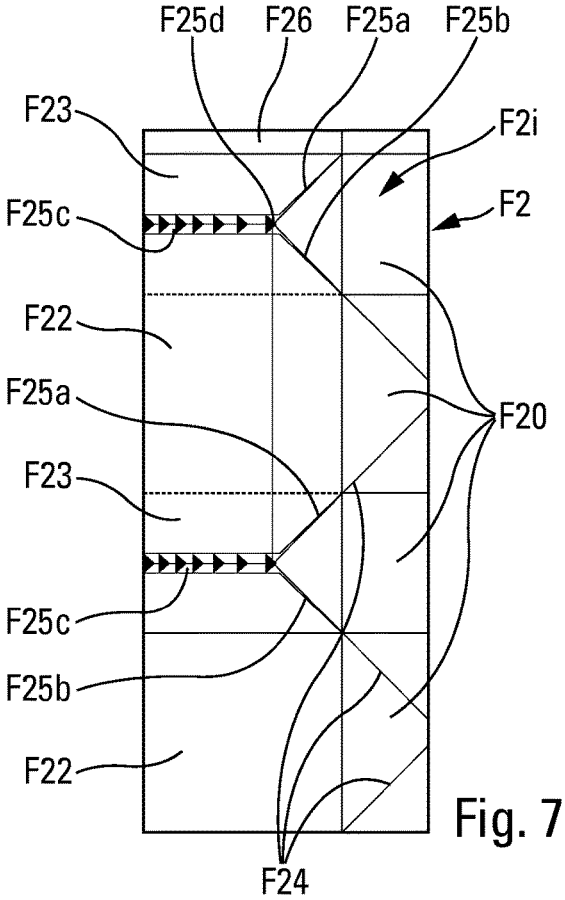
Figure 7B:
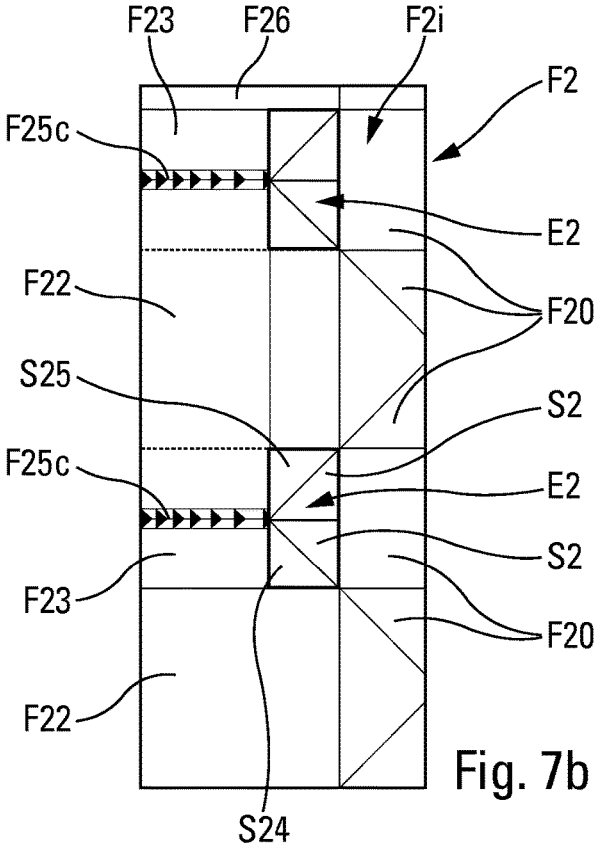

In the figures:

FIG. 1*a* is a plan view of a sheet suitable for use in making a bag in a first embodiment of the invention;

FIG. 1*b* is a view of the same sheet with gusset elements fitted thereto and fastened thereon;

FIG. 2*a* is a plan view in the initial or unfolded state of a gusset element in a first embodiment of the invention;

FIG. 2*b* is a view of the FIG. 2*a* gusset element while it is being folded;

FIG. 2*c* is a perspective view of the gusset element of FIGS. 2*a* and 2*b* in the folded state;

FIG. 3*a* is a diagram of a line for fabricating a bag of the invention from a roll of sheet material;

FIG. 4*a* is a diagram of a handle that can be fitted to and fastened on the FIG. 3*a* roll of sheet material;

FIGS. 4*b* and 4*c* are identical to FIGS. 2*a* and 2*b*, and make it possible to understand how the gusset elements can be integrated on the sheet of the FIG. 3*a* roll;

FIG. 4*d* shows in greater detail how the gusset element is fitted to and fastened on the sheet of the FIG. 3*a* roll;

FIG. 3*b* is a diagram showing the following portion and the end of the FIG. 3*a* fabrication line, with bags of the invention being obtained from its end;

FIG. 5*a* is a very diagrammatic view of the bag in the first embodiment of the invention with the gusset elements made visible by transparency;

FIG. 5*b* is another perspective view of the FIG. 5*a* bag;

FIG. 5*c* shows two stacks of bags made in the first embodiment of the invention;

FIG. 6*a* is a substantially realistic perspective view of the bag in the first embodiment of the invention;

FIG. 6*b* is a diagrammatic view of the FIG. 6*a* bag while it is being unfolded;

FIG. 6*c* is a plan view of the bag of FIGS. 6*a* and 6*b* in the fully unfolded state;

FIGS. 7*a* and 7*b* are views similar to FIGS. 1*a* and 1*b* for a second embodiment of the invention;

FIG. 8*a* is a plan view of a gusset element in this second embodiment of the invention while in its initial or unfolded state;

FIG. 8*b* shows the FIG. 8*a* gusset element while it is being folded;

FIG. 8*c* shows the gusset element of FIGS. 8*a* and 8*b* in the folded state and ready to be fitted and fastened on the sheet of FIG. 7*a;*

Figure 9A:
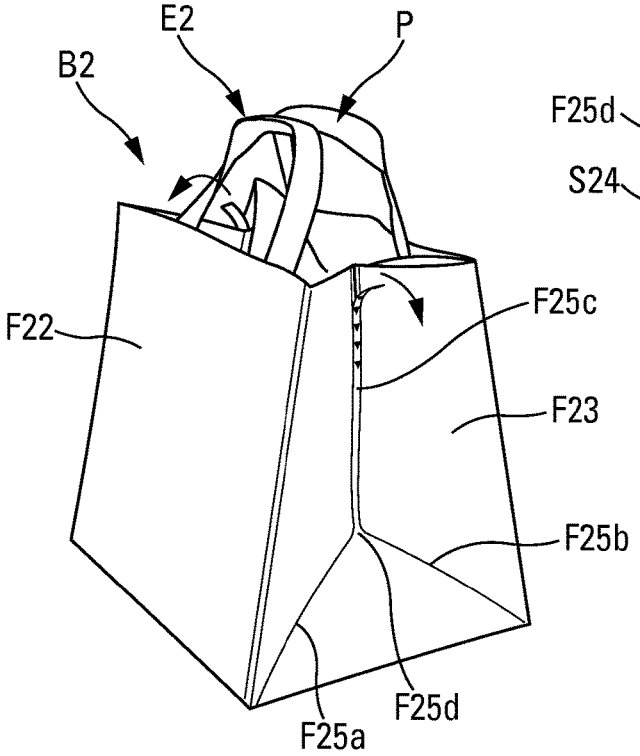
Figure 9B:
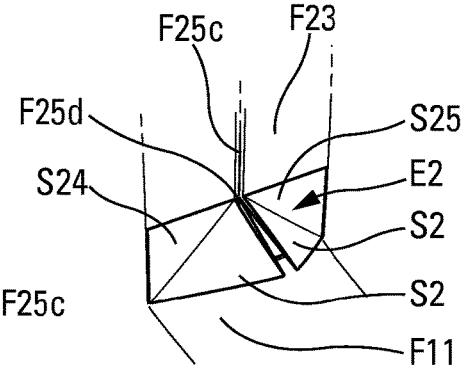
Figure 9C:
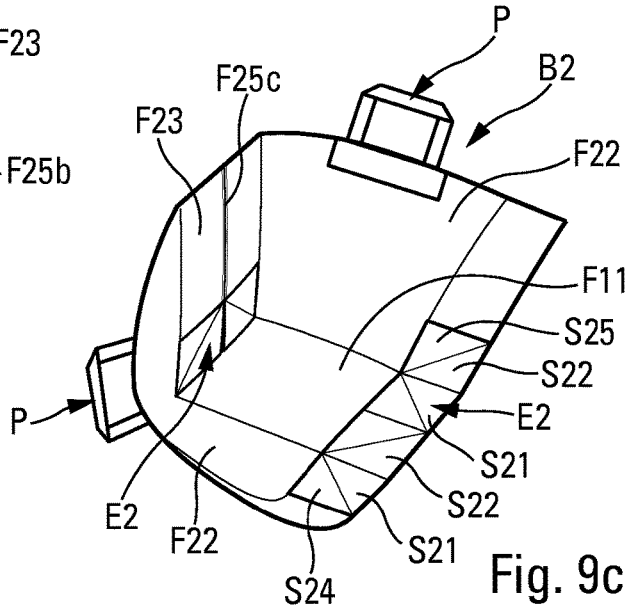
Figure 9D:
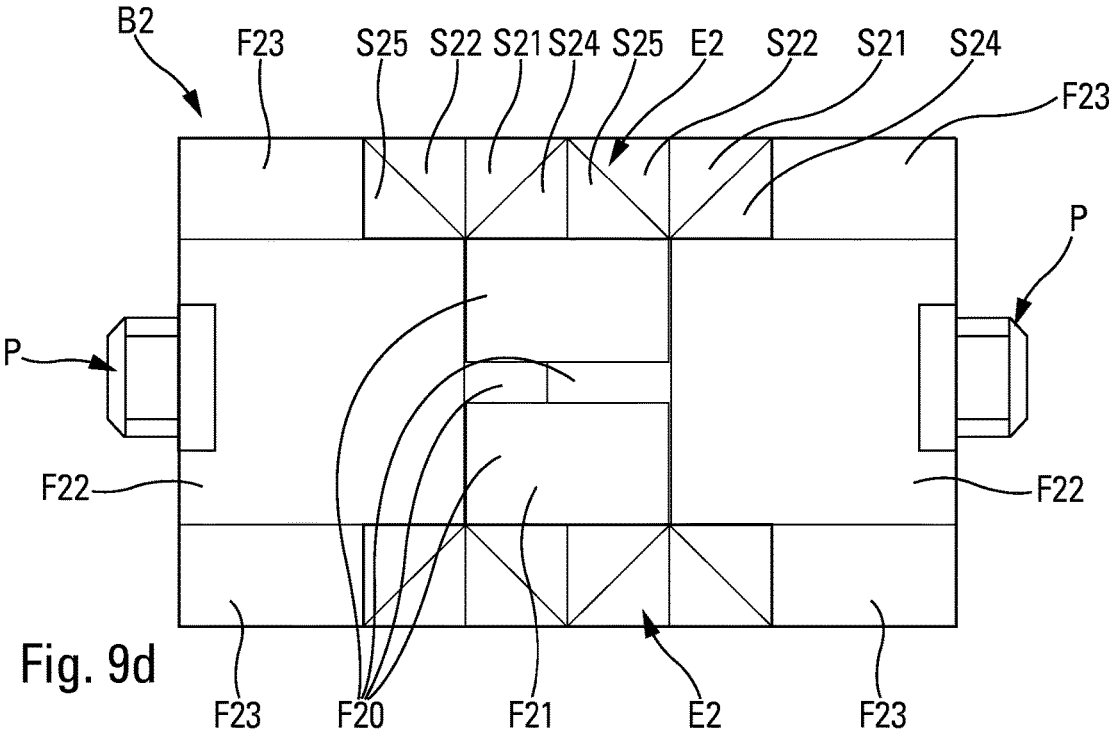

FIG. 9*a* is a substantially realistic perspective view of a bag in this second embodiment;

FIG. 9*b* shows a detail of the inside of the bag in which the gusset element of this second embodiment of the invention can be seen;

FIG. 9*c* is a diagrammatic perspective view of the bag of FIG. 9*a* while it is being unfolded; and FIG. 9*d* is a plane view of the bag of FIGS. 9*a* and 9*b* in the fully unfolded or deployed state.

Reference is made initially to FIGS. 1*a,* 1*b,* 2*a,* 2*b,* and 2*c* for describing in detail the various component elements and how they are arranged of an article carrier bag in a first embodiment of the invention. These figures do not show the bag in its final state, but they serve to understand how it is fabricated. The first main component element of the bag S1 is a sheet F1 that is visible in FIG. 1*a,* and that is right in shape in this example. The sheet F1 may be made out of any suitable flexible material, such as paper, an appropriate plastics material, etc. It is common practice to use kraft paper for this type of bag. The sheet F1 is shown on its inside face or wall F11. The sheet F1 defines a plurality of zones that are separated by fold liens F14 that are used to form the bag and to stack it while flat.

Initially, the sheet F1 defines four sides F12, F13 that are identical in pairs. The two sides F12 are substantially square in configuration, while the other two sides F13 are right in configuration. The sides F12 and F13 are arranged beside one another in alternating manner. The sheet F1 also defines flaps F10 that extend parallel to the column of sides F12, F13. After folding, the flaps F10 form the bottom F11 of the bag S1, as described below. The sheet F1 also has an assembly tongue F16 that extends over the entire width of the side F12, and also over the flap F10. This assembly tongue F16 serves to constitute a closed cylinder by being fitted against the bottom edge of the side F13 that is situated at the bottom of the sheet F1. At this stage, the sheet F1 presents a configuration that is entirely conventional for an article carrier bag, such as for example the bag used in fastfood businesses for taking away hot cooked dishes.

In the invention, the sides F12, F13 are connected to one another by frangible zones F15 that are easily broken. These frangible zones F15 are situated exactly at the connecting edges interconnecting two adjacent sides, once the bag has been formed. It could also be said that the connecting edges formed by the sides of the bag are designed so as to facilitate tearing the bag in controlled manner. These frangible zones F15 may be constituted by a local reduction in the wall thickness of the sheet F1, or by pre-cutting the sheet. By way of example, pre-cutting may comprise perforating dots or longer shapes. By way of example, the frangible zone may be made up of pre-cuts that are several centimeters long and that are spaced apart by zones that are intact, but weakened or pre-cut. The frangible zone may also be in the form of a traction strip or tongue on which the user pulls. Whatever the nature and the structure of these frangible zones, their main function is to generate controlled tearing of the sheet F1, more particularly along its connecting edges. The frangible zones F15 may even extend into the flaps F10.

In FIG. 1*a*, there can also be seen a plurality of fastener zones Z14 and Z15 that are represented by dashed lines. There can be seen four pairs of fastener zones Z14 and Z15 that extend along and on either side of the frangible zones F15. The first pair situated at the top of FIG. 1 comprises a zone F14 that extends over the assembly tongue F16 and a zone F15 that extends along the side F12. Each of the other three pairs extends over one side F12 and one side F13. These zones Z14 and Z15 may be coated in adhesive. They may extend over the flaps F10.

FIGS. 2*a*, 2*b*, and 2*c* show the gusset element E1 that is used for making the bag S1 in the first embodiment of the invention. The gusset element E1 in this example is made from a piece of sheet material that may be substantially similar or identical in kind to the sheet F1. They may be rigid or semi-rigid in order to increase the rigidity of the sides against which they are pressed, thereby increasing the stability of the tablecloth, once the bag has been unfolded. This piece of sheet material is in the form of one-fourth of a circle or of a pie chart with two straight edges arranged at right angles and a rounded edge occupying a one-fourth circle that connects together the two straight edges. It may be observed that the gusset element E1 defines two gussets leaves S11 and S12 that are identical by mirror symmetry about a fold line S13. The two gussets leaves S11 and S12 are hinged to each other along the fold line S13. Each gusset leaf S11 and S12 forms one-eighth of a circle. It may also be observed that the gusset element E1 has two elongate fastener tabs S14 and S15 for fastening the gusset element E1 on the sheet F1, as described below with reference to FIG. 1*b*. The elongate fastener tabs S14 and S15 extend at right angles to each other in FIG. 2*a*, which corresponds to the initial or unfolded state of the gusset element E1. The two elongate tabs S14 and S15 are thus in contact with each other via sloping bottom edges. The tab S14 is connected to the gusset leaf S11 along a fold line, while the tab S15 is connected to the gusset leaf S12 along another fold line perpendicular thereto.

It can thus easily be understood that it is possible to fold the gusset element E1 of FIG. 2*a* into a configuration as shown in FIG. 2*b*, with the two gusset leaves S11 and S12 forming an angle between them and with the tabs S14 and S15 likewise forming angles relative to their respective leaves S11 and S12.

By continuing to fold the gusset element E1, the folded configuration of FIG. 2*c* is finally reached in which the two gusset leaves S11 and S12 are arranged in parallel and in contact with each other, with the two fastener tabs S14 and S15 arranged adjacent each other in the same plane. It can also be said that the two gusset leaves S11 and S12 extend in a plane perpendicular to the planes of the fastener tabs S14 and S15.

In the invention, four gusset elements E1 while in the folded state (FIG. 2*c*) can be fitted on the sheet F1 so that the fastener tabs S14 and S15 of a given gusset element E1 become positioned respectively on a pair of fastener zones Z14, Z15 on either side of the frangible zone F15. It can thus be said that the two elongate fastener tabs S14 and S15 of a given gusset element E1 are separated by the frangible zone F15. The first gusset element E1 at the top of FIG. 1*b* has its tab S14 fastened on the tongue F16 and its other tab S15 fastened on the side F12. It may be observed that the tips of the tabs extend over the flaps F10. The second highest gusset element E1 in FIG. 1*b* has its tab S14 fastened on the side F12 and its other tab S15 fastened on the side F13. The third gusset element E1 is fastened astride on the sides F13 and F12, and the last gusset element E1 at the bottom of FIG. 1*b* is fastened astride the sides F12 and F13. The tabs S14 and S15 may be fastened on the sheet F1 by any appropriate technique, such as adhesive or heat sealing. It can thus be said that the sheet F1 defines fastener zones that extend along and on either side of the frangible zones F15. These fastener zones are visible in FIG. 4*d*, which is described below. Once the elements E1 are in place on the sheet F1, the gusset S1 can be folded onto one another in pairs, as shown in FIG. 1*b*. In other words, the leaves S11 and S12 can be folded onto the larger sides F12, while leaving the smaller sides F13 free.

With this configuration as shown in FIG. 1*b*, the sheet F1 can be rolled up and closed by fastening the assembly tongue F16 to the bottom edge of the lowest side F13 in FIG. 1*b*, e.g. by using adhesive. A cylinder is thus constituted that can be folded appropriately to make up the bottom of the bag by using the flaps F10. The bag S1 in the first embodiment of the invention is thus completed. It may optionally also be provided with handles for gripping and carrying it.

Reference is now made to FIGS. 3*a* to 5*c* in order to describe how the bag of FIGS. 1*a* to 2*c* can be made using a conventional fabrication method. The various workstations are not shown, but it is possible to understand the various fabrication steps starting from a roll R of sheet material similar or identical to the sheet F1. Once a length has been unrolled from the roll, the first step can consist in making pre-cuts or lines of weakness in the sheet so as to form the frangible zones F15. An optional second step may consist in placing and fastening two handles P on the sheets, which can be seen more clearly in FIG. 4*a*. Thereafter, a first pair of gusset elements E1, as shown in FIGS. 4*b* and 4*c*, can be fitted and fastened in the folded state onto the sheet astride two frangible zones F15. The other two gusset elements E1 can then be fitted and fastened on the sheet astride two frangible zones F15 so that the four gusset elements E1 are then in place on the sheet. With reference more particularly to FIG. 4*d*, it can be seen how a gusset element E1 is fitted in the folded state and fastened on the sheet of the roll via two fastener zones Z14 and Z15 that run along either side of a frangible zone F15. These zones Z14 and Z15 may be coated in adhesive prior to fitting on the gusset element E1 so as to fasten it on these adhesive-coated zones via its two fastener tabs S14 and S15.

Apart from the presence of the handles P, the length of the roller R on which the four gusset elements E1 are fastened presents a configuration identical to that of FIG. 1*b*.

In FIG. 3*b*, there can be seen the same configuration as FIG. 1*b* that is about to be rolled up to constitute a cylinder C. The cylinder is then shaped so as to create the connecting edges in the frangible zones F15. A segment of the cylinder is then detached so as to reveal the handles P. An additional step consists in applying adhesive on and folding the flaps F10 so as to make up the bottom F11 of the bag B1. As can be seen in FIG. 5*a*, the two leaves of the gusset elements E1 extend over the inside walls of the large sides F12. In FIG. 5*b*, it can be seen that the bottom F11 is folded so that it extends substantially in the same plane as the large sides F12, while the small sides F13 are folded in half. This is a completely usual configuration for a bag in the fastfood field, apart from including the gusset elements E1 of the invention. Such bags B1 can thus be arranged in stacks T, as shown in FIG. 5*c*.

Reference is now made to FIGS. 6*a*, 6*b*, and 6*c* to describe how the bag B1 in the first embodiment of the invention can be torn and unfolded so as to constitute an acceptable tablecloth. In FIG. 6*a*, the bag B1 can be seen in its final utilization state with its bottom arranged flat and the small sides F13 substantially or completely flat so that the bag B1 constitutes a storage space formed by the inside walls of the bottom F11 and of the sides F12 and F13 of the sheet F1. In this state, articles, such as beverages and cooked dishes can be arranged inside the bag B1 on the bottom F11. It may be observed in FIG. 6*a* that the substantially vertical connecting edges joining together the sides F12 and F13 form frangible zones F15 that may for example be in the form of tearable tongues or strips that can be pulled. Thus, a user can pull on these tongues or strips so as to separate the two sides from each other. In FIG. 6*b*, there can be seen the bag while it is being unfolded, after the frangible zones F15 have been torn. Finally, in FIG. 6*a*, the bag B1 can be seen in its completely unfolded or deployed state, revealing the bottom F11 constituted by the folded and superposed flaps F10 together with the four sides F12, F13 and also the four gusset elements E1 with their fastener tabs S14 and S15. The bag B1 then presents a configuration that is entirely conventional for a tablecloth. Because the frangible zones are easily broken and because the bag once unfolded is in the form of a rectangle with rounded corners and without breaks (i.e. not in the form of a cross), there is no need to extract the contents from the bag on going from bag mode to tablecloth mode.

Reference is now made to FIGS. 7*a*, 7*b*, 8*a*, 8*b*, and 8*c* for describing a second embodiment of a bag B2 of the invention. As in the first embodiment, a main component element of the bag is a sheet F2 forming flaps F20, two large sides F22 and two small sides F23. The sheet F2 also has an assembly tongue F26 and it presents fold lines F24.

In accordance with the invention, the sheet F2 has two frangible zones situated in the small sides F23. Each of these frangible zones comprises two frangible lines F25*a* and F25*b* that are arranged relative to each other so as to form a right angle or bracket shape. One end of each frangible line F25*a*, F25*b* touches a flap F20, and the lines meet at a junction point F25*d*, situated in this example substantially at one-third of the width (in the figure) of the side wall F23. In accordance with the invention, an additional frangible segment F25*c* may extend from the junction point F25*d* to the free edge of the side F23, as can be seen in FIG. 7*a*. It can thus be said that the frangible zone of a side F23 presents a Y-shaped configuration. As in the first embodiment of the invention, the frangible zones may be made by reducing the wall thickness of the sheet F2 or by pre-cuts. The frangible segment F25*c* may be made in the form of a tearable tongue or strip on which the user can pull.

This bag B2 has two gusset elements E2 that can be made from a sheet of right shape having its length corresponding to four times its width. Thus, the sheet may be subdivided into four squares, each of which can be split in half along its diagonal so as to form right isosceles triangles. With reference to FIG. 8*a*, it can be seen that the tab element E2 comprises eight right isosceles triangles formed by four squares having their diagonals extending in a zigzag configuration. Among these eight isosceles right triangles, there can be found two pairs of adjacent isosceles right triangles S21, S22 that are connected together along fold lines S23. Each pair of triangles forms a large right isosceles triangle that is hinged along the fold line S23. The two large isosceles right triangles are connected solely via their points at 45°. The other four isosceles right triangles form fastener tabs S24, S25 that are to be fastened, e.g. by adhesive or by heat sealing, onto the sheet F2 where they form the frangible lines F24*a* and F25*b*.

In FIG. 8*b*, it can be seen how the sheet of FIG. 8*a* can be folded along the lines S23 and the diagonals so as to reach a folded state as shown in FIG. 8*c*. It can then be observed that the gusset element E2 forms two gussets S2, each constituted by two gusset leaves S21 and S22. The fastener tabs S24 and S25 of each gusset S2 are fastened along and on either side of the frangible lines 25*a* and 25*b*.

With reference to FIG. 7*b*, two gusset elements E2 can be seen in the folded state that are fitted on and fastened to the two small sides F23 adjacent to the flaps F20 and contiguous with the end of the frangible segment F25*c*. It can be said that each gusset element E2 occupies substantially one-third of the total area of the side F23. It may also be observed that the gusset elements E2 do not overlap the flaps F20 or the large sides F22, nor even the assembly tongue F26: they are inscribed entirely within the sides F23.

It can be seen that the small side F23 defines four distinct fastener zones, namely two pairs of fastener zones Z24 and Z25 extending along and on either side of the frangible lines F25*a* and F25*b*. The fastener tabs S24 are fastened on the fastener zones Z24 and the fastener tabs S25 are fastened on the fastener zones Z25.

In FIG. 9*a*, there can be seen the bag B2 in the second embodiment of the invention. More particularly, there can be seen the side F23 with its two frangible lines F25*a* and F25*b* that meet at the junction point F25*b* from which the frangible segment F25*c* extends until it reaches the top of the bag. FIG. 9*b* shows a detail of the inside of the bag in which the gusset element E2 can be seen fastened on the inside wall of the side F23. The two gussets S2 together with the two fastener tabs S24 and S25 can be seen. The bottom F11 can also be seen.

A user can then pull on the frangible segments F25*c* to tear the side 23 down to the junction point F25*d*. By continuing to apply traction on the segment F25*c*, the frangible lines F25*a* and F25*b* give way so as to enable the bag to be opened in a configuration as shown in FIG. 9*c*. The gusset element E2 can then be seen as shown in FIG. 8*a*. By proceeding in the same manner on the second side F23, the user reaches the fully unfolded or deployed configuration shown in FIG. 9*d*. There can then be seen the two gusset elements E2 as shown in FIG. 8, i.e. in the initial or unfolded state, together with the two large sides F22 and the four ends of the sides F23 that have been torn apart. There can also be seen the bottom F21 constituted by the flaps F20 that have been folded, superposed, and stuck together.

Instead of the frangible zones F15 of the first embodiment and the frangible lines F25*a* and F25*b* and the frangible segments F25*c* of the second embodiment, it is possible to make use of cutter wires each presenting a handle end that the user can grip in order to pull strongly enough thereon to cut through the side wall. These wires could be fastened, e.g. lightly adhesively bonded, on the inside walls of the sides with their handle grip ends projecting from the bag.

In both of the above-described embodiments of the invention, the bags B1 and B2 have gusset elements E1 and E2 that are fitted on and fastened to a sheet while they are in the folded state, which sheet is then profiled, assembled, and folded in order to make up a usable bag. The gusset elements E1 and E2 are fastened astride or on either side of frangible lines or zones that the user can easily break in order to unfold or deploy the bag into the shape of a suitable tablecloth. Both embodiments are described with a plurality of gusset elements, namely four in the first embodiment and two in the second embodiment; nevertheless, it is possible to envisage making bags with only one gusset element in order to be able to open the bag so as to form a tablecloth zone with one or two vertical screens that can give the user a certain amount of intimacy while eating.

The present invention is shown with reference to bags that are made by forming a continuous cylinder that is to constitute the four sides of the bag with a portion that is folded to make up the bottom. Nevertheless, the present invention can also be implemented with other bag architectures insofar as it is possible for a sheet constituting the bag to have gusset elements in the folded state fitted and fastened thereto.

The invention provides a bag of appearance that is entirely conventional, but that incorporates the additional function of enabling it to be torn and deployed easily so as to form a tablecloth.

The invention claimed is:

1. An article carrier bag (B1; B2), in particular of the fastfood takeaway type, the bag comprising a bottom (F11; F21) and sides (F12, F13; F22, F23) defining inside walls bounding an inside storage space, and being characterized in that at least one gusset element (E1; E2) in a folded state is fitted to and fastened on at least one inside wall of the sides (F12, F13; F22, F23) in two adjacent fastener zones (Z14, Z15; Z24, Z25) that are separated by a frangible zone (F15; F25*a;* F25*b*) provided in association with at least one side (F12, F13; F22, F23), so as to be capable of bringing the gusset element (E1; E2) into an unfolded state after breaking the frangible zone (F15; F25*a;* F25*b*);

wherein the frangible zone is formed in a side, the two adjacent fastener zones being provided on the side, respectively on either side of the frangible zone; and wherein the gusset element is made from a sheet presenting a width together with a length that corresponds to four times the width so as to define an alignment of four squares, each square being folded along one of its diagonals so as to define eight isosceles right triangles, two pairs of adjacent isosceles right triangles connected together via their points respectively forming the two gussets, while the other four isosceles right triangles form the four fastener flaps, the frangible zone having two frangible lines connected together at right angles at a junction point.

2. A carrier bag (B1; B2) according to claim 1, wherein the sides (F12, F13; F22, F23) are connected together so as to form a continuous cylinder (C), the bottom (F11; F21) being formed by a plurality of superposed folded flaps (F10; F20).

3. An article carrier bag (B1; B2), in particular of the fastfood takeaway type, the bag comprising a bottom (F11; F21) and sides (F12, F13; F22, F23) defining inside walls bounding an inside storage space, and wherein at least one gusset element (El; E2) in a folded state is fitted to and fastened on at least one inside wall of the sides (F12, F13; F22, F23) in two adjacent fastener zones (Z14, Z15; Z24, Z25) that are separated by a frangible zone (F15; F25*a*; F25*b*) provided in association with at least one side (F12, F13; F22, F23), so as to be capable of bringing the gusset element (El; E2) into an unfolded state after breaking the frangible zone (F15; F25*a*; F25*b*);

wherein the frangible zone (F25*a*, F25*b*) is formed in a side (F23), the two adjacent fastener zones (Z24, Z25) being provided on the side (F23), respectively on either side of the frangible zone;

wherein the gusset element (E2) comprises two gussets (S2), each between two fastener flaps (S24, S25) that extend adjacent to each other in the folded state and at right angles in the unfolded state; and wherein the two fastener flaps are in the form of isosceles right triangles.

4. A carrier bag (B1; B2) according to claim 3, wherein the sides (F12, F13; F22, F23) are connected together so as to form a continuous cylinder (C), the bottom (F11; F21) being formed by a plurality of superposed folded flaps (F10; F20).

5. An article carrier bag (B1; B2), in particular of the fastfood takeaway type, the bag comprising a bottom (F11; F21) and sides (F12, F13; F22, F23) defining inside walls bounding an inside storage space, and wherein at least one gusset element (E1; E2) in a folded state is fitted to and fastened on at least one inside wall of the sides (F12, F13; F22, F23) in two adjacent fastener zones (Z14, Z15; Z24, Z25) that are separated by a frangible zone (F15; F25*a*; F25*b*) provided in association with at least one side (F12, F13; F22, F23), so as to be capable of bringing the gusset element (E1; E2) into an unfolded state after breaking the frangible zone (F15; F25*a*; F25*b*);

wherein the frangible zone (F25*a*, F25*b*) is formed in a side (F23), the two adjacent fastener zones (Z24, Z25) being provided on the side (F23), respectively on either side of the frangible zone;

wherein the gusset element (E2) comprises two gussets (S2), each between two fastener flaps (S24, S25) that extend adjacent to each other in the folded state and at right angles in the unfolded state; and wherein the frangible zone has two frangible lines (F25*a*, F25*b*) connected together at right angles at the junction point having a frangible segment (F25c) connected thereto in the form of a tear-off pull strip that extends over the height of the side (F23).

6. The carrier bag according to claim 5, wherein the two fastener flaps are in the form of isosceles right triangles.

7. A carrier bag (B1; B2) according to claim 5, wherein the sides (F12, F13; F22, F23) are connected together so as to form a continuous cylinder (C), the bottom (F11; F21) being formed by a plurality of superposed folded flaps (F10; F20).

* * * * *